US008858274B2

(12) United States Patent
Jakoplic et al.

(10) Patent No.: US 8,858,274 B2
(45) Date of Patent: Oct. 14, 2014

(54) ELECTRIC TERMINAL

(71) Applicant: Yazaki Europe Ltd., Hemel Hempstead (GB)

(72) Inventors: Ivica Jakoplic, Krapinske Toplice (HR); Josip Jelak, Krizevci (HR); Raimund Ochs, Ostringen (DE); Uwe Speitmann, Solingen (DE); David Duncan, Boyne City, MI (US)

(73) Assignee: Yazaki Europe Ltd., Hertfordshire (GB)

( * ) Notice: Subject to any disclaimer, the term of this patent is extended or adjusted under 35 U.S.C. 154(b) by 15 days.

(21) Appl. No.: 13/727,824

(22) Filed: Dec. 27, 2012

(65) Prior Publication Data

US 2013/0244510 A1 Sep. 19, 2013

(30) Foreign Application Priority Data

Mar. 19, 2012 (EP) ..... 12160222

(51) Int. Cl.

| | |
|---|---|
| ***H01R 4/22*** | (2006.01) |
| ***H01R 13/18*** | (2006.01) |
| ***H01R 4/18*** | (2006.01) |
| ***H01R 13/11*** | (2006.01) |

(52) U.S. Cl.

CPC ..... *H01R 4/22* (2013.01); *H01R 13/18* (2013.01); *H01R 4/185* (2013.01); *H01R 13/11* (2013.01)

USPC ..... 439/877; 439/843

(58) Field of Classification Search

CPC ..... H01R 4/185; H01R 13/11; H01R 43/16; H01R 13/03; H01R 13/18; H01R 13/4223; H01R 13/53; H01R 43/04; H01R 43/048; H01R 4/184; H01R 4/188; H01R 4/20; H01R 4/22; H01R 4/48; H01R 4/64; H01R 9/16

USPC ..... 439/877, 748

See application file for complete search history.

(56) References Cited

U.S. PATENT DOCUMENTS

| | | | | | |
|---|---|---|---|---|---|
| 3,141,724 | A | * | 7/1964 | Raymond | 439/777 |
| 5,246,390 | A | * | 9/1993 | Egenolf | 439/839 |
| 5,295,873 | A | * | 3/1994 | Walbrecht | 439/839 |
| 5,573,434 | A | * | 11/1996 | Ittah et al. | 439/839 |
| 5,681,190 | A | * | 10/1997 | Childs | 439/856 |
| 5,716,244 | A | * | 2/1998 | Egenolf et al. | 439/843 |
| 5,795,196 | A | | 8/1998 | Hotea et al. | |
| 5,863,225 | A | * | 1/1999 | Liebich et al. | 439/845 |
| 5,951,336 | A | * | 9/1999 | Seko et al. | 439/745 |
| 5,951,338 | A | * | 9/1999 | Seko et al. | 439/843 |
| 5,975,964 | A | * | 11/1999 | Seko et al. | 439/857 |

(Continued)

FOREIGN PATENT DOCUMENTS

| | | |
|---|---|---|
| EP | 0313253 A2 | 4/1989 |
| EP | 0821438 A1 | 1/1998 |

(Continued)

*Primary Examiner* — Briggitte R Hammond
(74) *Attorney, Agent, or Firm* — Sughrue Mion, PLLC

(57) ABSTRACT

An electric terminal 1 comprising a terminal body 2 and a box-shaped hood 3 enclosing at least partially the terminal body 2, said hood 3 being bent from a sheet-metal part into the box-shaped design wherein the sheet-metal part has a first connecting end 20 and a second connecting end 21 both being bent towards each other, wherein said connecting ends 20, 21 of the sheet-metal part are form-fittingly connected to each other.

12 Claims, 2 Drawing Sheets

(56) References Cited

U.S. PATENT DOCUMENTS

| | | | | |
|---|---|---|---|---|
| 6,019,646 | A * | 2/2000 | Okamura et al. | 439/852 |
| 6,062,918 | A * | 5/2000 | Myer et al. | 439/839 |
| 6,186,840 | B1 * | 2/2001 | Geltsch et al. | 439/843 |
| 6,394,858 | B1 * | 5/2002 | Geltsch et al. | 439/852 |
| 6,672,910 | B2 * | 1/2004 | Hotea | 439/843 |
| 6,905,376 | B2 * | 6/2005 | Chen | 439/852 |
| 7,048,582 | B2 * | 5/2006 | Tabata et al. | 439/595 |
| 7,094,114 | B2 * | 8/2006 | Kurimoto | 439/839 |
| 7,294,027 | B1 * | 11/2007 | Tyler et al. | 439/845 |
| 7,419,410 | B2 * | 9/2008 | Myer et al. | 439/852 |
| 7,988,505 | B2 * | 8/2011 | Hotea et al. | 439/852 |
| 2007/0123093 | A1 * | 5/2007 | Lutsch et al. | 439/445 |
| 2013/0244510 | A1 * | 9/2013 | Jakoplic et al. | 439/877 |

FOREIGN PATENT DOCUMENTS

| | | | |
|---|---|---|---|
| EP | 0837529 | A1 | 4/1998 |
| EP | 1587171 | A1 | 10/2005 |
| FR | 2775131 | A1 | 8/1999 |
| FR | 2844104 | A1 | 3/2004 |
| JP | 2007-123265 | A | 5/2007 |

* cited by examiner

ELECTRIC TERMINAL

The invention relates to an electric terminal comprising a terminal body and a box-shaped hood. The hood encloses at least partially the terminal body. The hood is bent from a sheet-metal part into the box-shaped design wherein the sheet-metal part has a first connecting end and a second connecting end both being bent towards each other.

A multitude of such electrical terminals are for example provided in connections, used in motor vehicles on wire harnesses or for connecting electrically operated equipment elements of a motor vehicle. Such connectors have housings, in which often in several rows, one on top of another and next to each other cavities are formed, which, respectively, accommodate an electrical terminal. Additionally to each cavity a locking element in form of an elastic arm is arranged, which rests with a projection behind a corresponding contour of the terminal and especially its support element, so that the terminal is securely retained against pulling-out from the housing. Often so-called secondary locking means are also provided. Even if pulling forces act on the cable connected to the individual terminals, the electrical terminal should be securely held within the connector housing.

Additionally, depending on the application field, also the sealing of such connectors is important, as for example in the engine compartment of a motor vehicle a moist environment exists. Spray water can enter the area of such a connector. Because of this reason the individual electrical terminals have to be sealed. This can be achieved such, that to each individual electrical terminal a special seal is arranged, which is arranged in a corresponding opening in front of the cavity for the electrical terminal. Alternatively, the end of the connector, from which the terminals are inserted into the cavities, is provided with a seal, which covers the whole area of all insertion openings and has corresponding insertion openings for respectively one electric terminal, aligned to the individual cavity. As such electrical terminals are inserted normally after the assembly of the seals into the cavity of the connector, the electrical terminals have to be formed such, that a damage of the seal and thus a place of intrusion for water is prevented.

EP 1 780 835 B1 describes an electric terminal according to the preamble of claim 1. Disclosed is a housing having several cavities, to which respectively a locking arm is arranged, which abuts a projection on an electric terminal. The electrical terminal shown there comprises a terminal body having a connection portion with crimping tabs for connecting a cable and a contact portion achieving an electrically conductive contact with a complementary contact pin or contact blade of a counter-terminal. The contact portion has elastic contact arms integrally formed to the terminal body. The contact portion is enclosed by a box-shaped hood. The hood has four walls, forming in cross-section a hollow rectangle. The four walls are formed by bending a sheet-metal part into the box-shaped design, wherein the sheet-metal part has two connecting ends each having a connecting edge. The connecting edges of the two connecting ends are bent towards each other forming a seam along the extend of the hood. The box-shaped hood is secured by welding point along the seam. The hood has a relative smooth surface so that, when inserting such an electric terminal into a cavity of a connector closed by a seal, no damage is produced to the seal. However, the hood is cumbersome to manufacture and necessitates a bending manufacturing step and a welding manufacturing step.

It is the object of the invention to provide an electric terminal having a hood which can be manufactured more easily.

The object is achieved by an electric terminal comprising a terminal body and a box-shaped hood enclosing at least partially the terminal body, said hood being bent from a sheet-metal part into the box-shaped design. A first connecting end and a second connecting end of the sheet-metal part both are bent towards each other and form-fittingly connected to each other. The hood has a side wall formed by the connecting ends. The connecting ends comprise at least one lateral engagement arrangement securing the connecting ends against movement in a direction perpendicular to the plane of the connecting ends.

The connecting ends of the sheet-metal part are form-fittingly connected to each other. Therefore, it is not necessary anymore to secure the two connecting ends to each other by welding. The form fitting connection can be achieved only by bending the sheet-metal part. Hence, one of the manufacturing steps according to the prior art, i.e. the welding step, can be avoided.

The hood has a rectangular cross-section wherein the hood has a top wall, a bottom wall and two side walls. The connecting ends are forming one of the side walls.

The connecting ends also comprise at least one lateral engagement arrangement securing the connecting ends against movement in a direction perpendicular to the plane of the connecting ends. The lateral engagement arrangement prevents at least in one direction perpendicular to the plane of the connecting ends a relative movement of the connecting ends to each other. It can also be formed such that a movement in both directions perpendicular to the plane of the connecting ends can be prevented.

The connecting ends may comprise at least one longitudinal engagement arrangement securing the connecting ends against forces in the plane of the connecting ends. If forces are applied to the hood in directions within the plane of the connecting ends, i.e. in the plane of one wall of the hood, the connecting ends cannot be separated nor moved relative to each other.

According to an embodiment the longitudinal engagement arrangement can comprise a tab at one of the two connecting ends and a corresponding recess in the other one of the two connecting ends. The tab is form-fittingly arranged within the recess so that no movement of the two connecting ends relative to each other within the plane of the connecting ends is possible.

According to an embodiment the lateral engagement arrangement comprises a first contact portion and a second contact portion provided at the first end the second connecting ends, respectively, wherein the two contact portions are overlapping each other. The lateral engagement arrangement is arranged such that the first contact portion is held between the second contact portion and the terminal body. This arrangement provides that the first contact portion cannot move in any direction perpendicular to the plane of the connecting ends.

The contact portions can be embossed such that the contact portions are thinner than the rest of the sheet-metal part. The overlapping contact portions together, therefore, may not be thicker than the sheet-metal part. This embodiment ensures, that no additional space is necessary for the lateral engagement arrangement. Further, it realizes a clean and smooth outer surface to avoid damages to a seal when inserting the terminal through a hole of the seal. However, other designs may also be possible, such as a bended portion of one of the connecting ends forming a longitudinal recess for accommodating the contact portion of the other connecting end along a seam between the two connecting ends.

In an preferred embodiment a longitudinal engagement arrangement and a lateral engagement arrangement are provided in order to secure the connecting ends in all directions. Preferably two longitudinal engagement arrangements are provided wherein one lateral engagement arrangement is arranged between the two longitudinal engagement arrangements. Of course, further engagement arrangements can be provided.

A preferred embodiment of an electric terminal will now be described by way of example with respect to the figures.

Figure 3:
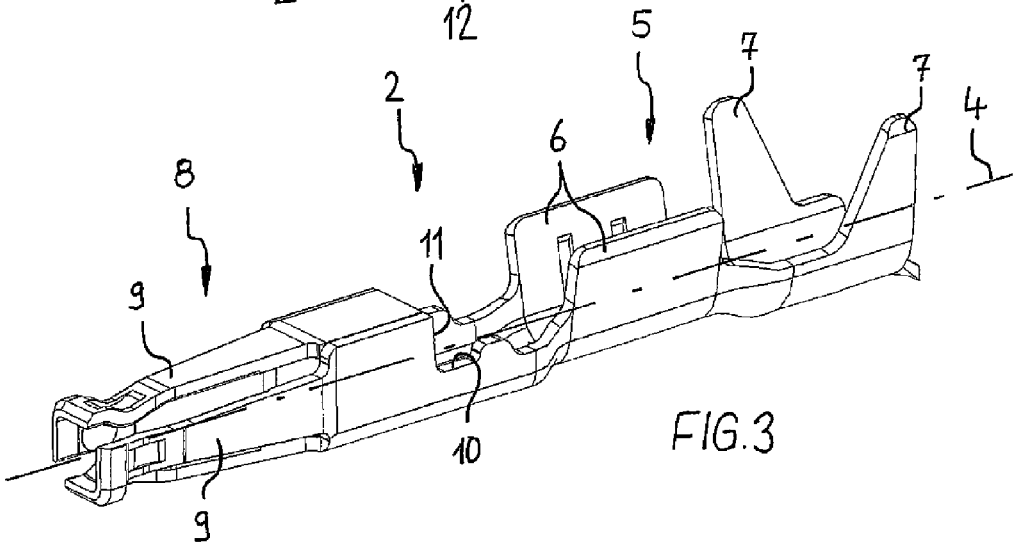
FIG. 3 is a perspective view of a terminal body of the electric terminal according to FIG. 1.

The electric terminal 1 comprises a terminal body 2 shown as an individual component in FIG. 3 and a hood 3. The hood 3 encloses the terminal body 2 on a partial length along the longitudinal axis 4.

Figure 1:
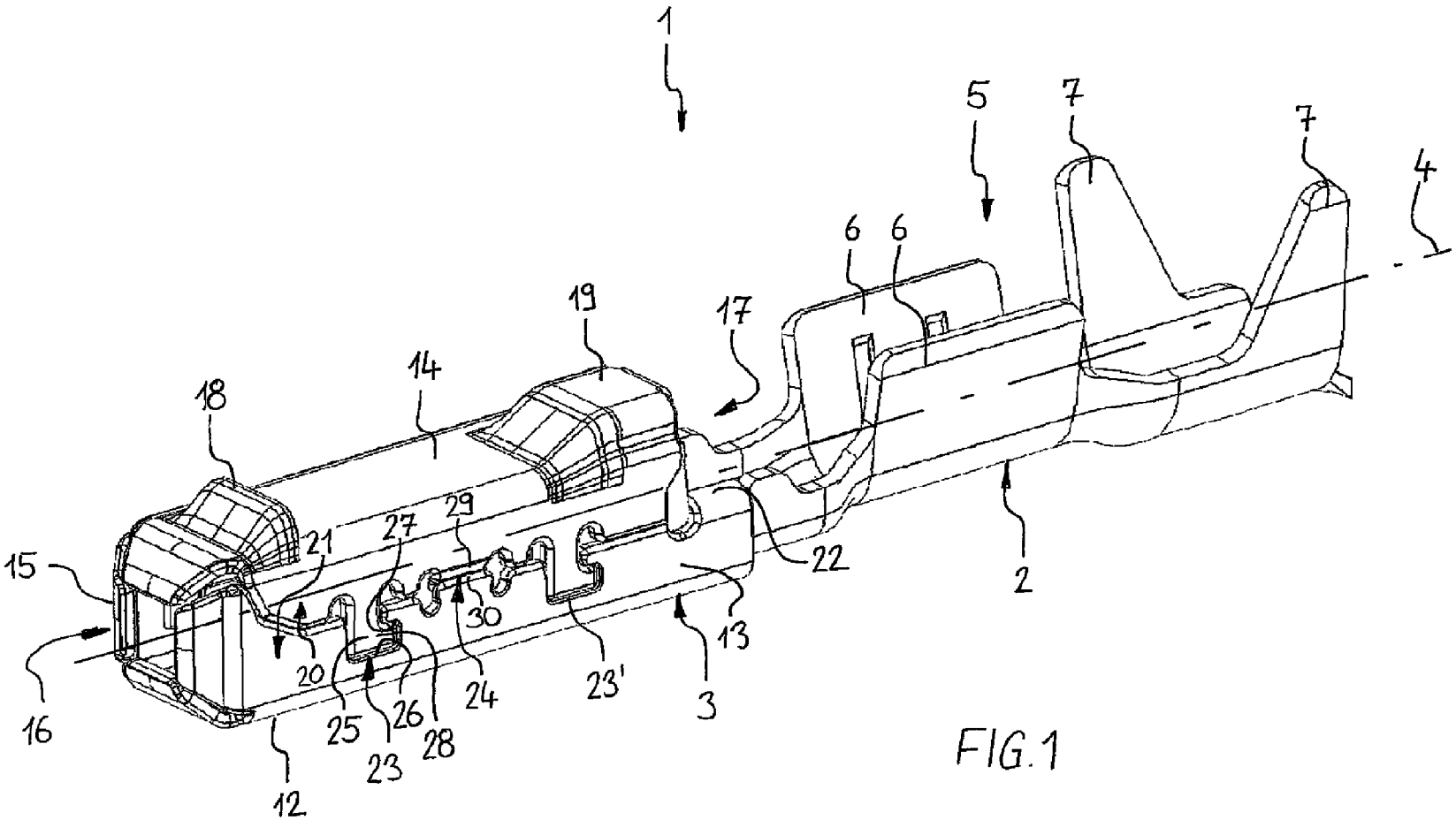
FIG. 1 is a perspective view of an electric terminal.

The terminal body 2 is manufactured from a sheet-metal material by means of bending wherein the sheet-metal material has an electrical conductivity, such as cooper or a copper alloy. The terminal body 2 comprises a connection portion 5 having two first crimping tabs 6 for connecting an electrical conductor of a cable to the terminal body 2 by means of crimping. Furthermore, two second crimping tabs 7 are provided to the right according to FIG. 1 on the connection portion 5. The two second crimping tabs 7 can be crimped to an insulation of a cable having the conductor. The first crimping tabs 6 and the second crimping tabs 7 start from a bottom portion. A contact portion 8 is integrally formed to the connection portion 5 as a hollow rectangular profile, wherein at the end thereof, which is facing away from the connection portion 5, contact arms 9 are attached. The contact arms 9 are formed elastically and serve to accommodate and to contact a contact pin or contact blade of a mating electric terminal, and thereby achieving an electrically conductive connection. In the direction towards the connection portion 5 the contact portion 8 ends with an end edge 11. At the connection portion 5, directly following the end edge 11, two recesses 10 are provided.

The contact portion 8 and the contact arms 9 of the terminal body 2 are enclosed by the hood 3. The hood 3 has also a hollow rectangular cross-section transversally to the longitudinal axis 4. This hollow rectangular cross-section is enclosed by four walls, namely a first wall (bottom wall) 12, a second wall (side wall) 13, following at a right angle thereto, a third wall (top wall) 14 following again thereto, and a fourth wall (side wall) 15 connecting the third wall 14 and the first wall 12. The hood 3 has a front end 16 and a rear end 17, wherein the term end is not a definitive end, but an end area or end portion.

The hood 3 is formed, starting from a sheet-metal part, having a corresponding preform, wherein this is preferably made from a material, which has a higher strength than the terminal body 2. Preferably a steel is used, i.e. especially a steel having spring characteristics and which is non corrosive. The hood 3 has, away from the longitudinal axis 4, two projections, formed by non-cutting working from the base material of the sheet-metal part forming the third wall 14, namely a first projection 18, close to the front end 16, and a second projection 19.

The second wall 13 is formed from a first connecting end 20 and a second connecting end 21 of the sheet-metal part, wherein these connecting ends abut each other and are arranged in a common plane. The hood 3 is provided with two securing lugs 22, which are bent over corresponding parts of the terminal body 2 each engaging one of the recesses 10 of the terminal body 2 in order to secure the hood 3 to the terminal body 2.

In the second wall of the box-shaped hood 3 two longitudinal engagement arrangements 23, 23', which are identical, and one lateral engagement arrangement 24 which is arranged between the two longitudinal engagement arrangements 23, 23' are provided. Each longitudinal engagement arrangement 23 comprises a tab 25. Integral to the first connecting end 20 and projecting in direction towards the second connecting end 21. The tab 25 is accommodated in a recess 26 of the second connecting end 21. The tab 25 and the recess 26 are formed complementary. The recess 26 has an undercut 27. The tab 25 has a corresponding projection 28 engaging the undercut 27 and thereby forming a form-fitting engagement. The tab 25 and the recess 26 are formed L-shaped. However, the tab 25 and the recess 26 can also have other shapes providing a form-fitting connection between the two connecting ends 20, 21. For instance, the tab 25 and the recess 26 could be T-shaped or bird-tail-shaped. Any kind of connection is possible provided that the two connecting ends 20, 21 are secured against a movement relative to each other in the plane of the second wall 13.

Figure 2:
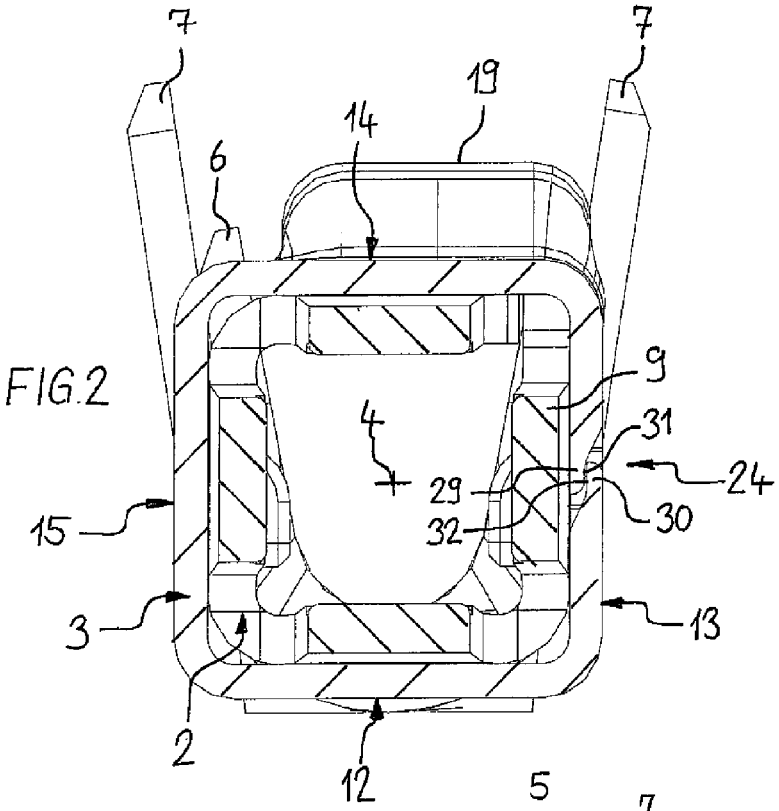
FIG. 2 is a cross-section view of the electric terminal according to FIG. 1 in the area of a lateral engagement arrangement.

The lateral engagement arrangement 24 has a first contact portion 29 being part of the first connecting end 20 and a second contact portion 30 being part of the second connecting end 21. The lateral engagement arrangement 24 is depicted in FIG. 2. The first contact portion 29 is embossed (flattened) in a direction perpendicular to the plane of a second wall 13 hereby forming a recess 31 facing the second connecting end 21. A second contact portion 30 is also embossed (flattened) such that a recess 32 is formed facing the first connecting end 20. Since both contact portions 29, 30 are arranged overlapping each other the second contact portion 30 is accommodated in the first recess 31 of the first connecting portion 29 and vice versa, i.e. the first contact portion 29 is accommodated in a second recess 32 of the second contact portion 30. Hereby, the contact portions 29, 30 have a thickness such that the overlapping contact portions 29, 30 together have approximately the same thickness as the rest of the sheet-metal part forming the hood 3. Thereby, no extra space has to be provided for the lateral engagement arrangement 24. In this embodiment the first contact portion 29 is held between the second contact portion 30 and one of the contact arms 9. Generally, the lateral engagement arrangement 24 can also have different designs as long as the contact portions 29, 30 are arranged in an overlapping manor. It can also be provided that the contact portions 29, 30 each have the same thickness as the sheet-metal parts. Further, one of the connecting ends 20 can be bent in an S-shape such that it forms a recess for the other connecting end.

The invention claimed is:

1. An electric terminal comprising a terminal body and a box-shaped hood enclosing at least partially the terminal body, said hood being bent from a sheet-metal part into the box-shaped design, and a first connecting end and a second connecting end of the sheet-metal part both being bent towards each other and form-fittingly connected to each other, wherein the hood has a side wall formed by the connecting ends, and wherein the connecting ends comprise at least one lateral engagement arrangement securing the connecting ends against movement in a direction perpendicular to the plane of the connecting ends, wherein said lateral engagement arrangement comprises a first contact portion and second contact portion provided at the first and the second connecting ends, respectively, overlapping each other, and wherein the contact portions are embossed such that the first and second contact portions are thinner than the rest of the sheet-metal part.

2. The electric terminal according to claim 1, wherein the first contact portion is held between the second contact portion and the terminal body.

3. The electric terminal according to claim 1, wherein the connecting ends comprise at least one longitudinal engagement arrangement securing the connecting ends in a plane of the connecting ends.

4. The electric terminal according to claim 3, wherein said lateral engagement arrangement is arranged between two of said longitudinal engagement arrangements.

5. The electric terminal according to claim 3, wherein said longitudinal engagement arrangement comprise a tab at one of the two connecting ends and a corresponding recess in the other one of the two connecting ends, and wherein the tab is form-fittingly secured in the recess.

6. The electric terminal according to claim 5, wherein the recess has at least one undercut and the tab has a corresponding number of corresponding projections.

7. An electric terminal comprising a terminal body and a box-shaped hood enclosing at least partially the terminal body, said hood being bent from a sheet-metal part into the box-shaped design, and a first connecting end and a second connecting end of the sheet-metal part both being bent towards each other and form-fittingly connected to each other, wherein the hood has a side wall formed by the connecting ends, wherein the connecting ends comprise at least one lateral engagement arrangement securing the connecting ends against movement in a direction perpendicular to a plane of the connecting ends, wherein the connecting ends comprise at least one longitudinal engagement arrangement securing the connecting ends in the plane of the connecting ends, and wherein said lateral engagement arrangement is arranged between two of said longitudinal engagement arrangements.

8. The electric terminal according to claim 7, wherein said longitudinal engagement arrangement comprise a tab at one of the two connecting ends and a corresponding recess in the other one of the two connecting ends, and wherein the tab is form-fittingly secured in the recess.

9. The electric terminal according to claim 8, wherein the recess has at least one undercut and the tab has a corresponding number of corresponding projections.

10. The electric terminal according to claim 7, wherein said lateral engagement arrangement comprises a first contact portion and second contact portion provided at the first and the second connecting ends, respectively, overlapping each other.

11. The electric terminal according to claim 10, wherein the first contact portion is held between the second contact portion and the terminal body.

12. The electric terminal according to claim 10, wherein the contact portions are embossed such that the contact portions are thinner than the rest of the sheet-metal part.

* * * * *